United States Patent [19]

Gavignet

[11] Patent Number: 4,867,254

[45] Date of Patent: Sep. 19, 1989

[54] METHOD OF CONTROLLING FLUID INFLUXES IN HYDROCARBON WELLS

[75] Inventor: Alain Gavignet, Sevres, France

[73] Assignee: Schlumberger Technology Corporation, Houston, Tex.

[21] Appl. No.: 227,273

[22] Filed: Aug. 2, 1988

[30] Foreign Application Priority Data

Aug. 7, 1987 [FR] France ..... 87 11259

[51] Int. Cl.[4] ..... E21B 47/10

[52] U.S. Cl. ..... 175/48; 175/50; 73/155

[58] Field of Search ..... 175/48, 40, 50; 73/151, 73/155

[56] References Cited

U.S. PATENT DOCUMENTS

| | | | |
|---|---|---|---|
| 3,726,136 | 4/1973 | McKean et al. | 175/48 |
| 3,740,739 | 6/1973 | Griffin, III et al. | 175/48 |
| 3,750,766 | 8/1973 | Thompson et al. | 175/48 |
| 3,982,432 | 9/1976 | Hammond | 73/155 |
| 4,188,624 | 2/1980 | Hochsprung et al. | 340/606 |
| 4,253,530 | 3/1981 | Sharki et al. | 175/48 |
| 4,527,425 | 7/1985 | Stockton | 73/155 |
| 4,565,086 | 1/1986 | Orr, Jr. | 175/40 |

*Primary Examiner*—Jerome W. Massie, IV
*Assistant Examiner*—Terry Lee Melius
*Attorney, Agent, or Firm*—Stephen L. Borst

[57] ABSTRACT

The invention relates to a method of real time control of fluid influxes into an oil well from an underground formation during drilling.

The injection pressure $p_i$ and return pressure $p_r$ and the flow rate Q of the drilling mud circulating in the well are measured. From the pressure and flow rate values, the value of the mass of gas $M_g$ in the annulus is determined, and the changes in this value monitored in order to determine either a fresh gas entry into the annulus or a drilling mud loss into the formation being drilled.

3 Claims, 3 Drawing Sheets

METHOD OF CONTROLLING FLUID INFLUXES IN HYDROCARBON WELLS

This invention relates to commonly assigned, copending patent application Ser. No. 07/216,579 filed July 8, 1988 entitled "Method of Detecting a Fluid Influx Which Could Lead to A Blow-Out During the Drilling of a Borehole".

The invention relates to the control of fluid influxes into a hydrocarbon well during drilling. When during the drilling of a well, after passing through an impermeable layer, a permeable formation is reached containing a liquid or gaseous fluid under pressure, this fluid tends to flow into the well if the column of drilling fluid, known as drilling mud, contained in the well is not able to balance the pressure of that fluid. The fluid then pushes the mud upwards. There is said to be a fluid influx or "kick". Such a phenomenon is unstable: as the fluid from the formation replaces the mud in the well, the mean density of the counter-pressure column inside the well decreases and the unbalance becomes greater. If no steps are taken, the phenomenon runs away, leading to a blow-out.

This influx of fluid is in most cases detected early enough to prevent the blow-out occurring. The first emergency step taken is to close the well at the surfaces by means of a blow-out preventer.

Once this valve is closed, the well is under control. The well then must be cleared of formation fluid, and the mud then weighted to enable drilling to continue without danger. If the formation fluid that has entered the well is a liquid (brine or hydrocarbon, for example), the circulation of tjhis fluid does not present any specific problems, since this fluid scarcely increases in volume during its rise to the surface and, therefore, the hydrostatic pressure exercised by the drilling mud at the bottom of the well remains more or less constant. If on the other hand the formation fluid is gaseous, it expands on rising and this creates a problem in that the hydrostatic pressure gradually decreases. To avoid fresh influxes of formation fluid being induced during "circulation" of the influx, in other words while the gas is rising to the surface, a pressure greater than the pressure of the formation has to be maintained at the bottom of the well. To do this, the annulus of the well, this being the space between the drill string and the well wall, must be kept at a pressure such that the bottom pressure is slightly higher than the formation pressure. It is therefore very important for the driller to know as early as possible, during circulation of the influx, if a dangerous incident is on the point of occurring, such as a fresh influx of fluid or the commencement of mud loss due to the fracture of the formation.

The means of analysis and control available to the driller comprise the mud level in the mud tank, the mud injection pressure into the drill pipes, and the well annulus surface pressure. In practice the driller does not make efficient use of these data until after an influx of fluid has been detected. In particular, he does not use the pressure and mud tank level measurements that are nevertheless at his disposal. He therefore has few means of detecting occurrences that may have serious consequences for operations.

The aim of the present invention is to assist the driller to detect dangerous occurrences during circulation of a gas influx, such as a fresh influx or mud losses. This is done by calculating, from the said measurements available to the driller, the value of a parameter that remains substantially constant if the phenomenon is stable. Any appreciable deviation from that value is interpreted as an instability, fresh fluid influx from the formation or mud loss into the formation. According to the preferred embodiment, the parameter chosen is the mass of gas present in the annulus. This calculated mass remains substantially unchanged as long as the well is entire, i.e. as long as there is no exchange with the formation.

More precisely, the invention relates to a method of realtime control of gas influxes from an underground formation into a well in the course of drilling, according to which the drilling mud injection pressure $p_i$ and the return pressure $p_r$ and the flow rate Q at which the drilling mud circulates in the wall are measured, and the drilling mud return pressure $p_r$ adjusted so as to maintain a pressure at the bottom of the well higher than the formation pressure. From the abovementioned pressures and flow rate, a value characteristic of a parameter of the gas during its rise through the well to the surface is determined at intervals, this parameter having a substantially constant value for a given influx, and the changes in that value are monitored.

The characteristics and advantages of the invention will be seen more clearly from the description that follows, with reference to the attached drawings, of a non-limitative example of the method mentioned above.

Figure 1:
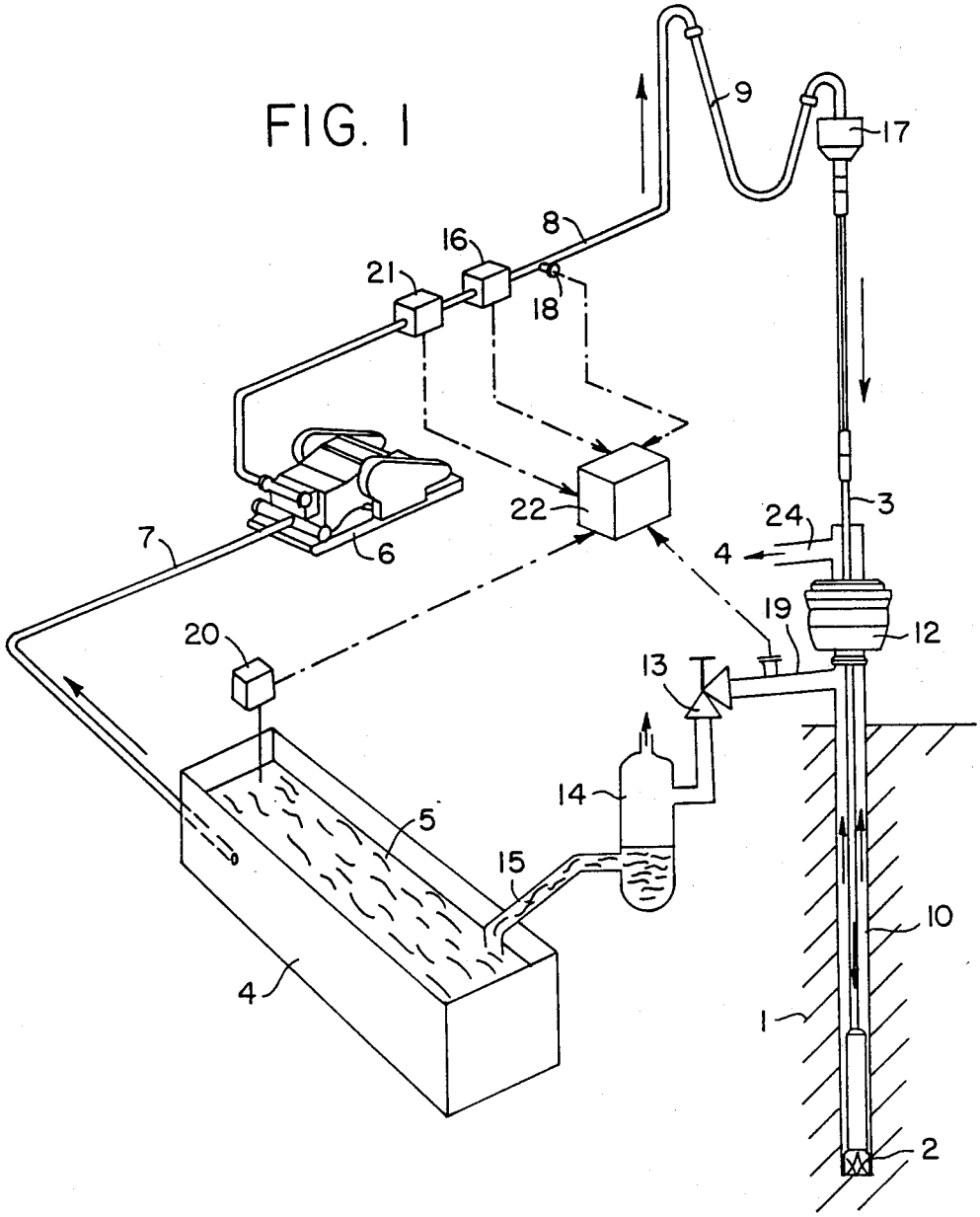
FIG. 1 shows in diagram form the drilling mud circuit generally used for rotary tyhpe well drilling.

FIG. 1 shows the mud circuit of a well 1 during a formation fluid influx control operation. The bit 2 is attached to the end of a drill string 3. The mud circuit comprises a tank 4 containing drilling mud 5, a pump 6 sucking mud from the tank 4 through a pipe 7 and discharging it into the well 1, through a rigid pipe 8 and flexible hose 9 connected to the tubular drill string 3 via a swivel 17. The mud escapes from the drill string when it reaches the bit 2 and returns up the well through the annulus 10 between the drill string and the well wall, which may comprise a casing string. In normal operation the drilling mud flows through a blow-out preventer 12 which is open and flows into the mud tank 4 through a line 24 and through a vibratory screen to separate the cuttings from the mud.

When a fluid influx is detected, the valve 12 is closed. On arrival at the surface, the mud flows through a choke 13 and a degasser 14 which separates the gas from the liquid. The drilling mud then returns to the tank 4 through line 15.

The mud inflow rate Q is measured by means of a flow meter 16 and the mud density $d_m$ is measured by means of a sensor 21, both of these fitted in line 8. The injection pressure $p_i$ is measured by means of a sensor 18 on rigid line 8. The return pressure $p_r$ is measured by means of a sensor 19 fitted between the flow-out preventer 12 and the choke 13. The mud level n in the tank 4 is measured by means of a level sensor 20 fitted in the tank 4.

The signals Q, $d_m$, $p_i$, $p_r$ and n thus generated are applied to a processing device 22, where they are processed in order to control influx circulation.

To explain the method for controlling formation gas influx, two extreme cases may be considered. Under a first hypothesis, the well is open at the surface (valve 12 is open and choke 13 closed) and drilling progresses without change. The gas produced by the underground formation rises in the annulus, and as it rises it expands because the hydrostatic pressure decreases. The gas therefore occupies an increasingly large volume in the annulus, this volume of gas replacing an equivalent volume of drilling mud, the density of which is greater than that of the gas. There ensues a progressive drop in the bottom hydrostatic pressure, with respect to the producing formation. More and more gas consequently escapes from the formation, and a blow out will result if the driller does not act. To intervene, and this is the second extreme hypothesis, the driller closes the blow out preventer 12. The gas, initially produced by the formation at the bottom pressure, rises to the surface but this time without expanding since the well is closed. On reaching the surface the gas is still at the initial bottom pressure. As a result, the bottom pressure is now equal to the pressure of the gas increased by the hydrostatic pressure exercised by the column of drilling mud in the annulus. This hydrostatic pressure is equal to the initial bottom pressure since neither the volume nor the density of the mud has changed. The bottom pressure is thus now equal to twice the initial bottom pressure.

This pressure is generally greater than the formation fracture pressure. If one were to operate according to the second hypothesis, the formation would therefore fracture and the drilling mud would be lost into the formation, causing irreparable damage. In practice the driller adopts a middle course between these two extremes of having the well either fully open or closed. The blow out preventer 12 is closed and the opening of choke 13 adjusted at intervals to keep the bottom pressure more or less constant.

The processing of the signals measured at the surface will now be described, using a relatively simple model to describe the behaviour of the gas during the control operation.

The method to be described below may, however, be adapted to more complex models if required.

Figure 2:
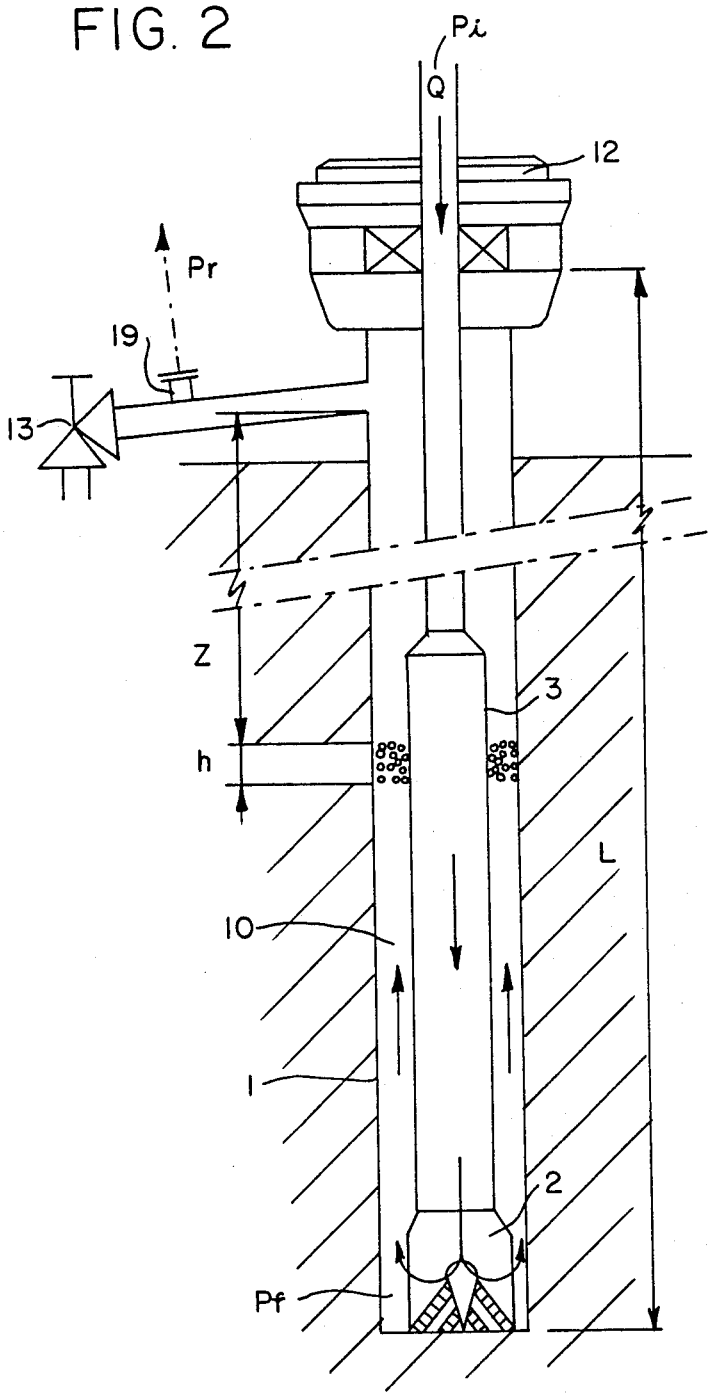
FIG. 2 shows in diagram form the annulus and the position of the gas in that annulus.

FIG. 2 shows in a very simple form the gas distribution in the annulus 10 shown in FIG. 1. For the sake of clarity in explaining the method, it will be assumed here that the section of the annulus has an area A constant from the bottom to the top of the well. But the method may be used even if this section is not of constant area. Let $p_f$ be the pressure at the bottom of the well at a given moment. When the mud circulates through the pipes 3, this pressure $p_f$ may be determined from the pressure $p_i$ at which the mud is injected into the pipes 3, measured by sensor 18. Pressure $p_f$ may be determined from $p_i$ by calculation, taking into account pressure losses due to friction between the mud and the sides of the drill string, or alternatively by calibration in situ, when the mud circulates directly towards surface tank 4 without passing through choke 13. This calibration procedure is systematically carried out at drilling sites.

Let L be the total depth of the well, i.e. the difference in elevation between the sensor 19 and the bit 2. At a given moment the gas that had entered the bottom of the well when the influx occurred is situated between the bottom and top of the well. Let us assume this gas to be evenly distributed through the mud over a distance h, as shown in FIG. 2, and the top of this area where the gas and the mud are present together in the annulus to be at vertical elevation z in relation to pickup 19. Leaving aside, in a first approximation, the pressure losses due to friction between the mud in the annulus and the well walls and drill pipes, the following equation obtains:

$$p_f - p_r = d_m g L + \frac{gM_g}{A}\left(1 - \frac{d_m}{d_g}\right) \quad (1)$$

where $d_g$ is the mean density of the gas, g is the gravitational acceleration and $M_g$ is the total mass of gas present in the annulus.

Using this equation, $M_g$ can thus be calculated if $d_g$ is known, since $d_m$, A and L are already known. This is interesting, as this calculated mass $M_g$ must remain constant if the annulus remains isolated during circulation, i.e. there is neither entry nor loss of fluid.

The mean density $d_g$ of the gas is linked to its mean pressure $p_g$ through the equation:

$$d_g = \frac{p_g}{ZkT} \quad (2)$$

where Z is the gas compressibility factor, k is the ratio of the Boltzmann constant to the molecular weight of the gas, and T is the absolute temperature of the gas. The mean pressure pg of the gas, at a point in the middle of the gas, at depth (z+h/2) may be obtained approximately by:

$$p_g = d_m g\left(z + \frac{h}{2}\right) \quad (3)$$

Note that to calculate $M_g$, the value of $p_g$ is first calculated by means of equation (3), the calculation of $M_g$ depending on the estimate of the mean position z+h/2 of the gas. The moment at which the gas penetrated the well from the formation is known. This moment in fact corresponds to a sudden rise in several parameters: the mud level in the mud tank, the mud outflow rate and generally the rate of penetration of the bit into the formation. Knowing this initial moment and the mud rate makes it possible to determine at any moment the mean depth z+h/2 of the gas in the annulus.

However, the gas in the drilling mud tends to rise due to buoyancy. Consequently the gas travels upwards towards the surface faster than the drilling mud. To calculate the mean density of the gas during circulation, a model of the gas slip in relation to the mud has to be used. Such models exist in published literature, from the simplest model which assumes the rate to be constant, to more complex ones that predict slip rate values depending in a fairly detailed way on the structure of the two-phase flow.

By way of example, the present invention uses the above equations to calculate the mass of gas present in the annulus, assuming a constant slip rate $V_g$ from the initial moment of gas production. The gas depth in the annulus is obtained from the equation:

$$z + \frac{h}{2} = \left(L + \frac{h_o}{2}\right) - \left(\frac{Q}{A} + V_g\right)t \quad (4)$$

where Q is the mud flow rate measured at the surface and $h_o$ the initial gas height at the bottom of the well.

According to the general principle of the present invention, a calculation is made at intervals of the gas pressure in the annulus at successive moments and the corresponding mass of gas $M_g$ is calculated using equations (1) to (4). The mass of gas is constant if there is no exchange of fluid with the formation. On the other hand, an increase in the calculated value of $M_g$ shows that a fresh influx of gas into the annulus has taken place. The driller therefore has to alter the opening of the choke 13 in order to raise the pressure $p_f$ at the bottom of the well. Inversely, a drop in the value of $M_g$ corresponds to a mud loss into the formation. The driller therefore has to act on the setting of the choke 13 so as to reduce the bottom pressure $p_f$.

The present invention can of course be applied by calculating the gas depth in the annulus from equation (4). In practice, however, the pressure $p_g$ of the gas in the annulus after a time t from the initial time $t_o$ may be calculated directly using the equation:

$$p_g = p_f - d_{mg} \int_{t_o}^{t} \left( \frac{Q}{A} + V_g \right) dt \tag{5}$$

It will be noted that $p_g$ is a function solely of Q and $V_g$. The density $d_g$ of the gas corresponding to the pressure $p_g$ is then calculated using the equation:

$$d_g = d_{go} \frac{p_g}{p_{go}} \tag{6}$$

$d_{go}$ and $p_{go}$ being respectively the density and the pressure of the gas at moment $t_o$. It will be noted that $p_{go} = p_f$.

From $d_g$ the corresponding mass $M_g$ can be determined from equation (1).

It should, however, be noted that the validity of the slip model used can be checked, in particular when circulation commences, by using the measurement n of the mud level in tank 4.

This level measurement may be used to determine the increase in volume of the gas during circulation. When the gas expands it in fact displaces the mud in the annulus, and the level in tank 4 rises. This variation in volume in tank 4 may therefore be used to ascertain the expansion of the gas in the annulus, and hence the mean pressure of the gas, linked to its mean depth. This can be used to calculate the rate of rise of the gas, and thus to check and if necessary adjust the model selected for the control method. It should be noted that the tank 4 level cannot be an accurate instantaneous measurement, in view of the agitation in the tank, but it can still be used to control the gas rise rate if the level is averaged over time.

In an alternative embodiment of the invention, the mass of gas $M_g$ is first determined as described above, then it is assumed during the subsequent measurement or measurements that there is no exchange of fluid with the formation. Consequently, any variation in the value of $M_g$ is interpreted as an initial error in the value of the slip rate $V_g$ (or in the model selected for $V_g$). The value of $V_g$ (or the model) is corrected by taking as the value of $M_g$ the value initially calculated. Once this correction has been made, the subsequent measurements are used to calculate the value of $M_g$. Any variation in this value is interpreted as an exchange of fluid with the formation.

Figure 3:
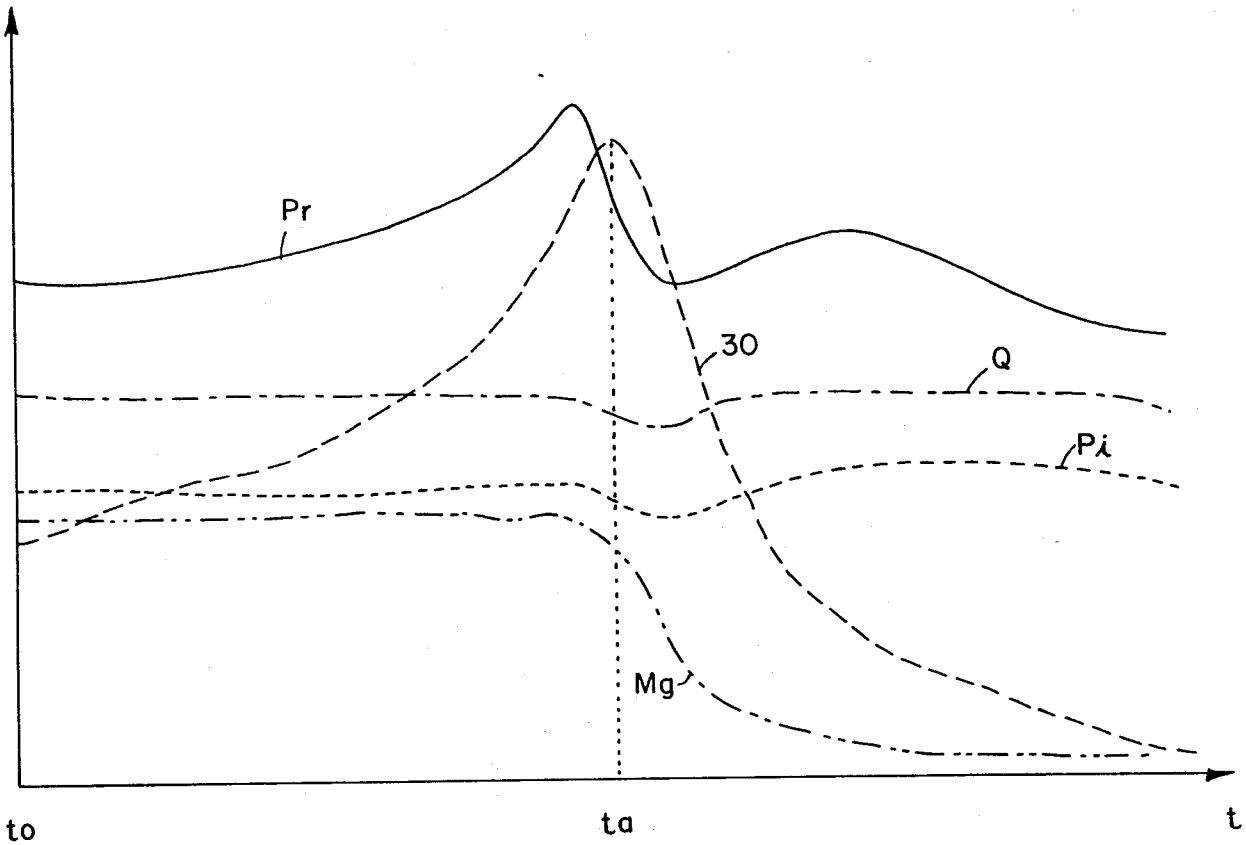
FIG. 3 shows an example of a result obtained with the method proposed within the scope of this invention.

FIG. 3 shows different curves representing over time t, the changing return pressure $p_r$, injection pressure $p_i$, mud rate Q, volume of mud in the mud tank (curve 30) and mass of gas $M_g$ calculated. The curves are represented from initial time $t_o$, when the gas first appeared in the well. It will be noted that the volume of mud in the tank (curve 30) rises to a maximum value corresponding to the time of arrival $t_a$ of the gas at the surface. At the same time $t_a$, the value of $M_g$ starts to fall. The rate Q and pressure $p_i$ remain more or less constant.

I claim:

1. A method of real time control of a gas influx or influxes from an undergound formation into a wellbore being drilled, the method comprising the steps of:

(a) measuring the drilling mud injection pressure $P_i$ and return pressure $P_r$ and the flow rate Q at which the drilling mud circulates in the well;

(b) deriving a value of the slip rate $V_g$ of the gas in relation to the drilling mud;

(c) determining the density $d_g$ of the gas from the flow rate Q and from said value of the slip rate $V_g$ of the gas;

(d) from said pressures and said gas density $d_g$, determining a value characteristic of the mass Mg of the gas at intervals during its rise through the wellbore towards the surface, said parameter having a substantially constant value for a given influx;

(e) monitoring changes in said value; and (f) adjusting the drilling mud return pressure $P_r$ so as to maintain a pressure at the bottom of the well higher than the formation pressure.

2. The method according to claim 1, wherein the slip rate $V_g$ is determined by measuring the increase in volume of the gas during its rise through the well.

3. The method according to claim 1 characterized in that after determining the value of the mass of gas $M_g$, this value is used to adjust the value of the slip rate $V_g$ during the subsequent measurement or measurements and in that the changes in said mass of gas $M_g$ with said value $V_g$ thus adjusted are then monitored.

* * * * *